US005791066A

United States Patent [19]

Crews

[11] Patent Number: 5,791,066

[45] Date of Patent: Aug. 11, 1998

[54] CYCLONIC DRYER

[75] Inventor: Richard S. Crews, Cerritos, Calif.

[73] Assignee: Hydrofuser Technologies, Inc., Newport Beach, Calif.

[21] Appl. No.: 706,342

[22] Filed: Aug. 30, 1996

[51] Int. Cl.[6] ..... F26B 17/12

[52] U.S. Cl. ..... 34/168; 34/173

[58] Field of Search ..... 34/314, 326, 136, 34/166, 168, 173; 159/4.01

[56] References Cited

U.S. PATENT DOCUMENTS

| | | | |
|---|---|---|---|
| 2,393,893 | 1/1946 | Evans et al. | 34/168 |
| 2,724,686 | 11/1955 | Nicholson | 34/168 |
| 3,766,661 | 10/1973 | Bayens et al. | 34/168 X |
| 3,800,429 | 4/1974 | Lindl | 34/79 |
| 4,052,255 | 10/1977 | Hackbarth et al. | 159/4.01 |
| 4,114,289 | 9/1978 | Boulet | 34/173 |
| 4,769,923 | 9/1988 | Chang | 34/582 |

OTHER PUBLICATIONS

A set of Integrated Environmental Systems (IES) (a predecessor to Applicant) drawings, entitled Riverside Paper, 1993.

A set of Crews Evaporator & Drier Co. (a predecessor to Applicant) drawings, entitled National Nutrient, Drier and Grinder Prelim, Jun. 26, 1992.

*Primary Examiner*—Henry A. Bennett
*Assistant Examiner*—Steve Gravini
*Attorney, Agent, or Firm*—Lyon & Lyon LLP

[57] ABSTRACT

An improved cyclone dryer is disclosed, having an upper, a lower cylinder and a cone-shaped chamber that define a cavity. The improved dryer is adapted for a high-speed airstream to enter the cavity via a tangential airstream orifice. Wet material is fed into the improved dryer via an input assembly that is mounted proximate an exhaust assembly and feeds wet material into the cavity, at a point proximate a lower portion of the cylinder and proximate the cone-shaped chamber.

23 Claims, 6 Drawing Sheets

CYCLONIC DRYER

FIELD OF INVENTION

This application relates to the field of industrial drying equipment, particularly cyclonic dryers used for drying, among other things, paper pulp and industrial and municipal sludge.

BACKGROUND

Cyclonic chambers are well known in the art and have been used in many applications, such as in separating, comminuting, mixing, and drying materials. In isolation, a cyclone is a simple mechanical device that can accomplish the above-listed tasks by using the force of gravity, centrifugal forces and pressure differentials at various points. Generally, cyclone chambers (hereinafter also referred to merely as "cyclones") are formed at least partially in the shape of an inverted cone, with the base (largest diameter) of the cone generally on top. Depending on their dimensions, the cyclones may also be in the shape of an inverted frustum, which is generally a cone shape where the small, tapered end has been cut off parallel to the base. Because cone-shaped cyclones and frustum-shaped cyclones are operationally similar, reference will be made herein primarily to a cone-shaped cyclone.

Cyclones may come in a variety of configurations that are intended for different applications. For example, as shown in FIG. 1, a cyclone is shown having a body 10 that comprises an upper, cylindrical shaped portion 12, and a lower, cone-shaped portion 11. FIG. 1 is described in the *Handbook of Industrial Drying*, pp. 728–733, at FIG. 11 (2nd Edition, Arun S. Mujumdar, editor, 1995). The cyclone shown and described there has three orifices for dust particles and air to enter and exit the cyclone. In the application described therein, an airstream containing dust particles enters the cyclone at an airstream input orifice 13, at a high velocity in a direction tangential to a center axis 14. The velocity is high enough so that the entering airstream is forced against the outside wall of the cyclone due to centrifugal forces. Gravity forces denser material (dust particles in this illustration) to fall, thereby resulting in a circular, downward vortex, as shown at 15. Gravity forces the dust particles eventually to escape through a bottom orifice 16 of the cyclone.

At the same time, a circular vortex is created that draws air upward inside the cyclone. This upward vortex 17 carries air and other particles up and out through an exit orifice 18. A number of factors determine which particles escape through the bottom orifice 16 or through the exit orifice 18. Among these factors are the pressures at each of the orifices, the velocity of the entering airstream and the velocity of each of the vortexes, the size and density of particles, the dimensions of the cyclone, and the structure of the interior of the cyclone. Generally, particles are carried upward via the upward vortex 17 when buoyant forces overcome the gravitational forces.

A cyclone such as that described above may be used to dry a wet substance as the substance is passed through the cyclone. Various methods have been used to effect the drying of the substance. For example, a wet substance may be introduced through the same tangential port where the high velocity airstream enters the cyclone. The substance is dried as the high velocity air impacts individual particles of the substance. Often, the air is heated to effect more efficient drying. Alternatively, the wet substance could be inserted separately at a point near where the tangential air stream enters the orifice, so that the air immediately impacts the substance and forces the substance to flow in a circular vortex. Another similar drying method uses a variant on the cyclone chamber, and is commonly called a spray dryer. A spray dryer operates by reducing the material to be dried into small droplets, then subjecting those small droplets to a large amount of hot air, thereby supplying the heat necessary to evaporate the liquid.

None of these prior dryers are able to efficiently dry large volumes of sticky, pasty material, such as paper pulp and municipal sludge. One of the problems with the prior dryers is that the sticky and pasty materials tend to stick to the sides of the cyclone. This vastly reduces the efficiency of the dryer because the air, even if it is heated and spinning rapidly, can only affect a small part of the surface area of the substance to be dried. Further, the material that sticks to the side interferes with the smooth airflow necessary to create an efficient vortex. While it may be possible for spray dryers to be adapted to handle sticky and pasty material, their inefficiency and reliability is a drawback.

SUMMARY OF THE INVENTION

The present invention provides an improvement on the forementioned dryers by creating an efficient apparatus and process for drying large quantities of sticky or pasty substances. Such substances include, among others, paper slurry that is left over from paper manufacturing, and municipal and industrial sludge. Some prior attempts at drying material with a cyclonic chamber, as described above, used high velocity air or other gases and forced the wet material to the outside diameter of the cyclone, due to centrifugal forces. The present invention, however, introduces the wet material into the cyclonic chamber at a novel position so as to partially suspend the wet material between an outer, downward vortex, and inner, upward vortex. The downward vortex is created due to centrifugal forces and gravitational forces, resulting in a generally circular and downward vortex. The upward vortex is created due to the shape of the cyclonic chamber. The downward vortex forces air and material into the lower portions of the cyclonic chamber, which is the smallest portion of the chamber. This results in the creation of a high pressure zone that forces the air upward, thereby creating a collapsing force in an upward direction. Momentum from the downward vortex makes the air and some of the lighter particles spin in the same direction about the cyclonic axis. The result is an inner, upward vortex about the center axis.

The intersection of the outer (downward) and inner (upward) vortexes creates a turbulent boundary layer. The present invention dries wet material by at least partially suspending the material in the boundary layer between the outer and inner vortexes. The material is suspended due to the countervailing forces acting on it. Centrifugal force and gravity act to push the material downward, yet the collapsing forces keep the material from immediately being forced to the outside and downward, effectively counteracting the centrifugal and gravitational forces. The time that the material is suspended in the cyclonic chamber is proportional to the rate of drying. The dimensions of the cyclonic chamber and the operating parameters can be varied to adjust the time that the material is suspended, with a resultant variation in the amount of drying.

The preferred dryer adds a number of other novel features to optimize drying efficiency. The various features each affect at least one of the performance factors such as pressure differential(s), speed of the airstream, temperature, and turbulence inside the dryer. The preferred dryer is also constructed so as to enable flexibility in configuring single or multiple dryers into systems for drying.

The preferred dryer operates at a higher pressure differential than prior dryers. The preferred dryer may operate with a pressure of 15–30 inches of water at the air inlet, compared to a maximum of approximately 12 inches of water in existing dryers. The preferred dryer is also adapted to handle a larger flow of air at a higher velocity. Further, the preferred dryer may be operated at geometric positions not used before, including varying body angles (for the vacuum chamber) and feed tube angles. The preferred feed tube location has also been changed to enhance the efficiency of the dryer. Lastly, the relative and absolute measurements of the vacuum chamber have been modified to enhance efficiency.

Accordingly, it is an object of the present invention to provide an improved cyclonic dryer.

BRIEF DESCRIPTION OF THE DRAWINGS

This and other objects of the present invention will become better understood through a consideration of the following description taken in conjunction with the drawings in which:

FIG. 3 is a perspective view of the preferred cyclone dryer (the same view as shown in FIG. 2), showing the views from which

DETAILED DESCRIPTION

Figure 2:
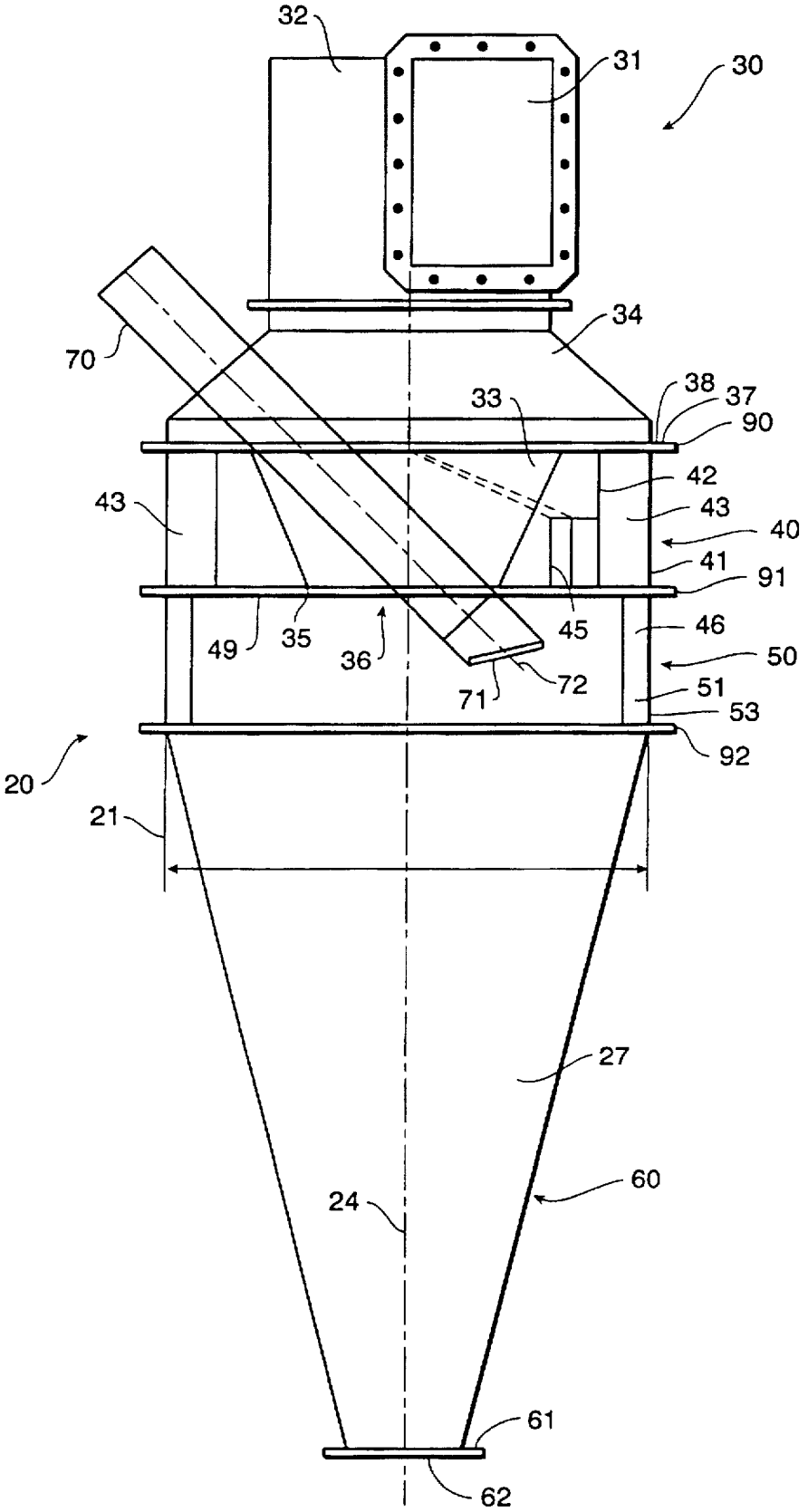
FIG. 2 is a perspective view of a preferred cyclone dryer according to the present invention, illustrating the major components and the flow of air and material through the cyclone.

Turning now to the drawings, FIG. 2 depicts a preferred cyclone dryer 20 for drying various sticky substances. The preferred dryer 20 comprises cyclone chamber 21 having a cone-shaped chamber 60, a lower cylinder 50, an upper cylinder 40, and an exhaust assembly 30, all of which form a cavity 27. Viewed from the outside, the basic construction of the preferred cyclone chamber 21 is similar to those known in the art. For example, the cyclone body 10 described as representative of the prior has an upper, cylindrical portion 12 and a lower, cone-shaped portion 11. The preferred upper cylinder 40 and lower cylinder 50 form what appears from the outside to be a single cylinder. operationally, the upper cylinder 40 and lower cylinder 50 could alternatively be a unitary cylinder. However, the preferred embodiment employs two cylinders, for the reasons detailed below. For clarity, the preferred dryer 20 will be described in two general sections. First, the structure of the preferred embodiment will be described, followed by a description of the operation of the preferred embodiment. The structure will be described generally in the same sequence as the operation, beginning with the components related to the air inlet.

Structure of the Preferred Embodiment

Preferably, a high velocity airstream enters the cyclone chamber generally proximate the upper cylinder 40. The preferred upper cylinder 40 comprises an outer surface 41 and an inner surface 42, each surface generally forming a cylinder. The preferred upper cylinder 40 further comprises a disk-shaped lower surface 46 (FIG. 5 actually shows the surface 46 attached to the lower cylinder 50) and is bounded on the top by a disk-shaped first collar 90. The three surfaces 41, 42, and 46, and the first collar 90, generally define a disk-shaped annular air chamber 43. The purpose of this chamber 43 is to allow for heated or ambient air (or gas or other fluids—reference hereinafter to air includes other gases) to be introduced into the cyclone chamber 21. The novel structure of the preferred embodiment allows flexibility in positioning the ducting and fans necessary to input air into the cyclone chamber 21. FIG. 3B shows the preferred annular air chamber 43, with an airstream inlet orifice 47 having deflectors 44. The preferred orifice 47 and deflectors 44 make it possible to introduce an airstream into the cyclone chamber 21, and immediately deflect the airstream so that it is rotating tangentially around a center axis 24 of the cyclone chamber 21. The inlet orifice 47 and the deflectors 44 can be located at any point around the outer surface 41 of the upper cylinder 40.

Methods and devices for providing a high velocity airstream at various temperatures are known in the art, so these are not shown in the figures herein. Generally, a high speed air source and a heat source could be either attached directly to the inlet orifice 47, or connected via ducting.

Figure 5:
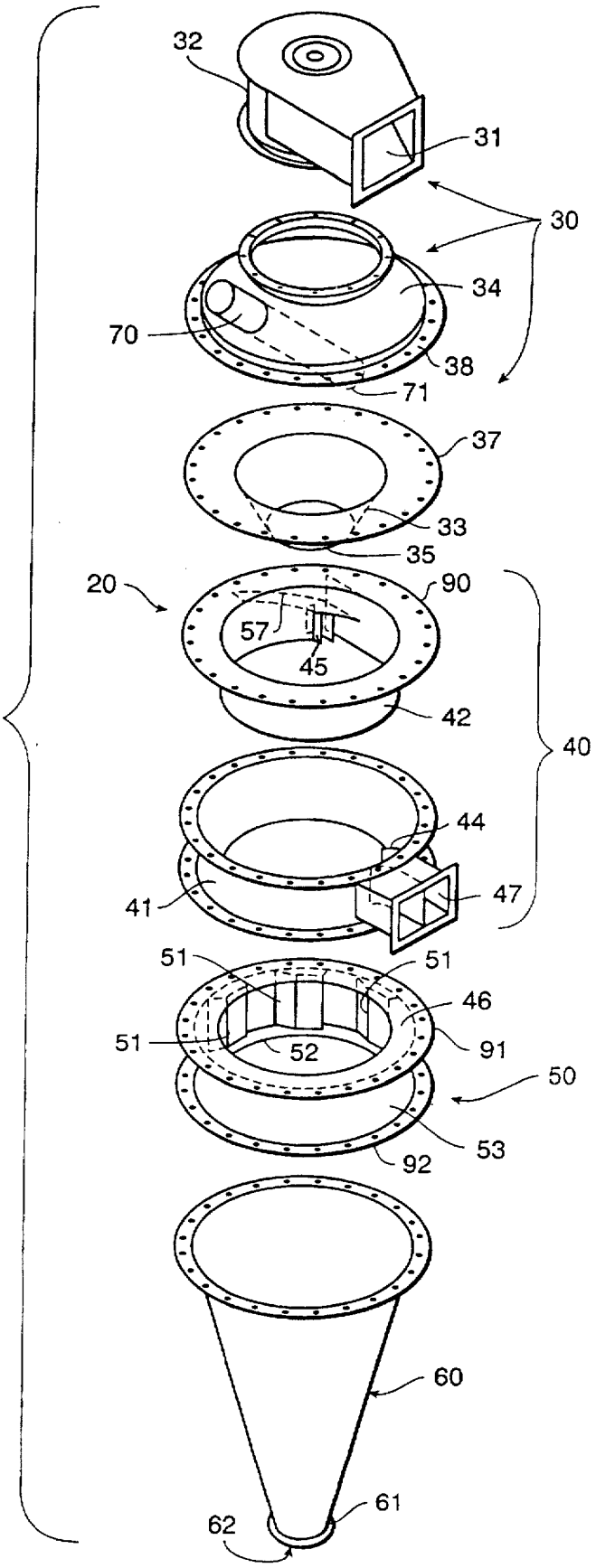
FIG. 5 is an exploded view of the preferred cyclone dryer, showing the relationship of major components as they would appear prior to assembly.

The preferred upper cylinder 40 is mounted atop a lower cylinder 50, both cylinders preferably having a substantially similar outside diameter. As shown in FIG. 2, the cylinders 40 & 50 are attached via a second collar 91, which encircles the outside of the cyclone chamber 21 (collar 91 and surface 46 may alternatively be constructed of a single component). The cavity 27 is generally open between the upper cylinder 40 and the lower cylinder 50, as shown by area 49 in FIG. 3B. There may be a small, radial flange that protrudes partially radially from the second collar 91 into the cavity 27. The lower cylinder 50 has a bottom flange 52, as shown in FIGS. 3A & 5, an outer surface 53, and a third collar 92. Preferably attached to the interior of the outer surface 53 are a plurality of ramp members 51 that act like "speed bumps". When viewed from the top (as in FIG. 3A), these ramp members 51 are shaped like fins. The preferred ramp members 51 extend the vertical height of the lower cylinder 50. The preferred ramp members 51 are adapted to create turbulence in the cyclone chamber 21 to promote more efficient drying. Various other shapes may also be used for the ramp members 51 in order to create turbulence. The ramp members 51 are preferably constructed using steel, although other materials known in the art may be used for increased corrosion and wear resistance. The flange 52 extends radially into the cavity 27, which is open to a cone-shaped chamber 60 below (the opening is shown at 54 in FIG. 3A).

The lower cylinder 50 is preferably attached to the coneshaped chamber 60. The lower, cone-shaped chamber 60 tapers to a point or tip 61, shown at the bottom of FIG. 2, that forms an output port 62. It is at this point that dried or partially dried material preferably exits the preferred dryer.

Adjacent the upper cylinder 40 of the cyclone chamber 21 is an exhaust assembly 30. The preferred exhaust assembly 30 shares generally a similar shape with the cyclone chamber 21, and has a cylindrical-shaped upper portion 32 (hereinafter referred to as the exhaust cylinder) and a cone-shaped (or frustum-shaped) lower portion 33. The lower portion 33 may more accurately be described as having a frustoconical shape (referred to as a frustum), because the bottom of the lower portion 33 (the "tip" of the cone) is cut off. The lower portion 33 has a collar 37 that substantially matches the size of the disk-shaped first collar 90. A middle exhaust portion 34 connects the upper portion 32 and the lower portion 33, and is shaped to provide continuity between those portions. The middle portion 34 acts as a cap and has a collar 38 that fits over and substantially matches the outer diameter of the lower collar 37. A bottom edge 35 of the preferred frustum 33 is mounted at approximately the same height as the lower surface 46 of the upper cylinder 40 of the cyclone chamber 21. The bottom edge 35 of the frustum 33 forms an opening 36 to allow air, other gases, and other material to be expelled upward during operation of the preferred dryer. The frustum 33 and the exhaust cylinder 32 form an open cavity through which air, other gases, and other material may pass. An exhaust port 31 preferably is located adjacent the top of the exhaust cylinder 32. The exhaust port 31 may vent gases and other materials into the atmosphere or into a collection means as is known in the art and not shown herein. The exhaust port 31 shown in FIG. 2 may vent air horizontally (out of the page). It would be possible to alternatively vent air vertically out of the top of exhaust assembly 30.

Figure 4:
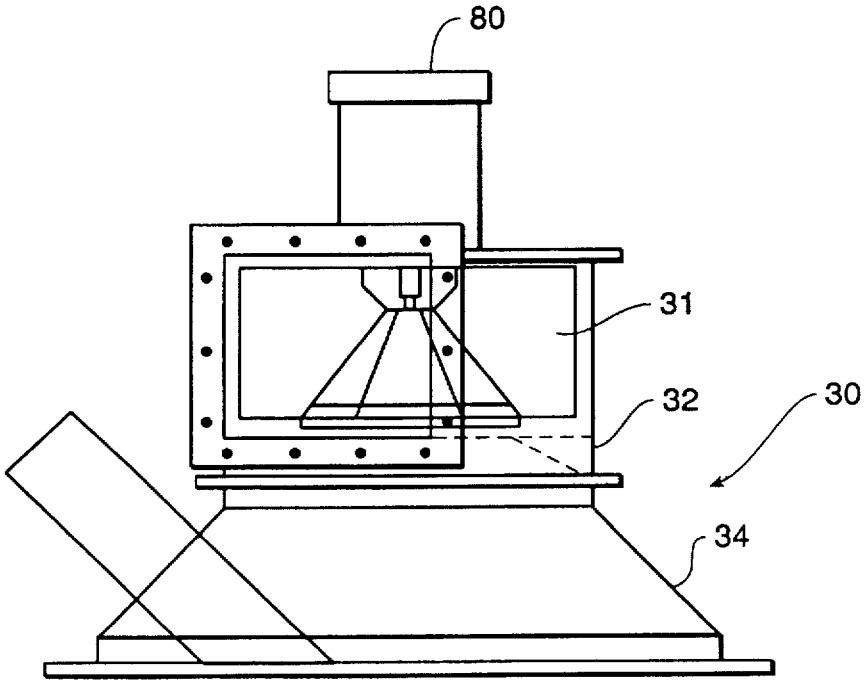
FIG. 4 is a perspective view of the preferred cyclone dryer as shown in FIG. 2, additionally showing a fan added to an exhaust assembly.

In order to create a lower pressure at the exhaust port 31, the preferred cyclone dryer 20 may have an exhaust fan 80 mounted proximate the exhaust assembly 30, as shown in FIG. 4. The preferred fan 80 is generally described as a paddle wheel material handling fan (or backward incline fan). The preferred fan 80 has an outside diameter of 21½ inches and a 3 horsepower, variable speed drive. The preferred fan preferably can create a measured pressure of approximately 0" water column.

An, input assembly 70 is preferably mounted adjacent the exhaust assembly 30. The input assembly 70 preferably comprises a pipe that feeds wet material into the cyclone chamber 21 cavity 27. An input port 71 is preferably formed at a lower end of the input assembly 70, for depositing wet material into the cavity 27. The location of the input port 71 is important to maximize the drying efficiency of the preferred dryer, as will be discussed in detail below. The preferred input is different than existing inputs of other cyclone dryers for at least the following reasons. First, the angle of the input assembly 70, in relation to the center axis 24 of the cyclone dryer 20, is generally about 45 degrees versus a range of less than 40 degrees for existing dryers. Second, the input port 71 is placed at a different point within the cavity 27 to maximize the efficiency of the dryer 21. Preferably, a center axis 72 of the input assembly enters the cavity 27 at a point approximately halfway between the center axis 24 of the dryer 20 and the inner surface 42 of the upper cylinder 40.

Operation of the Preferred Embodiment

The preferred dryer works as described below. The preferred cyclone dryer 20 is constructed so as to create a downward, circular vortex, and then an upward, circular exhaust vortex. This is done in the following manner. First, an air stream is introduced into the annular air chamber 43 by injecting high velocity air tangentially into the preferred dryer 20.

Figure 1:
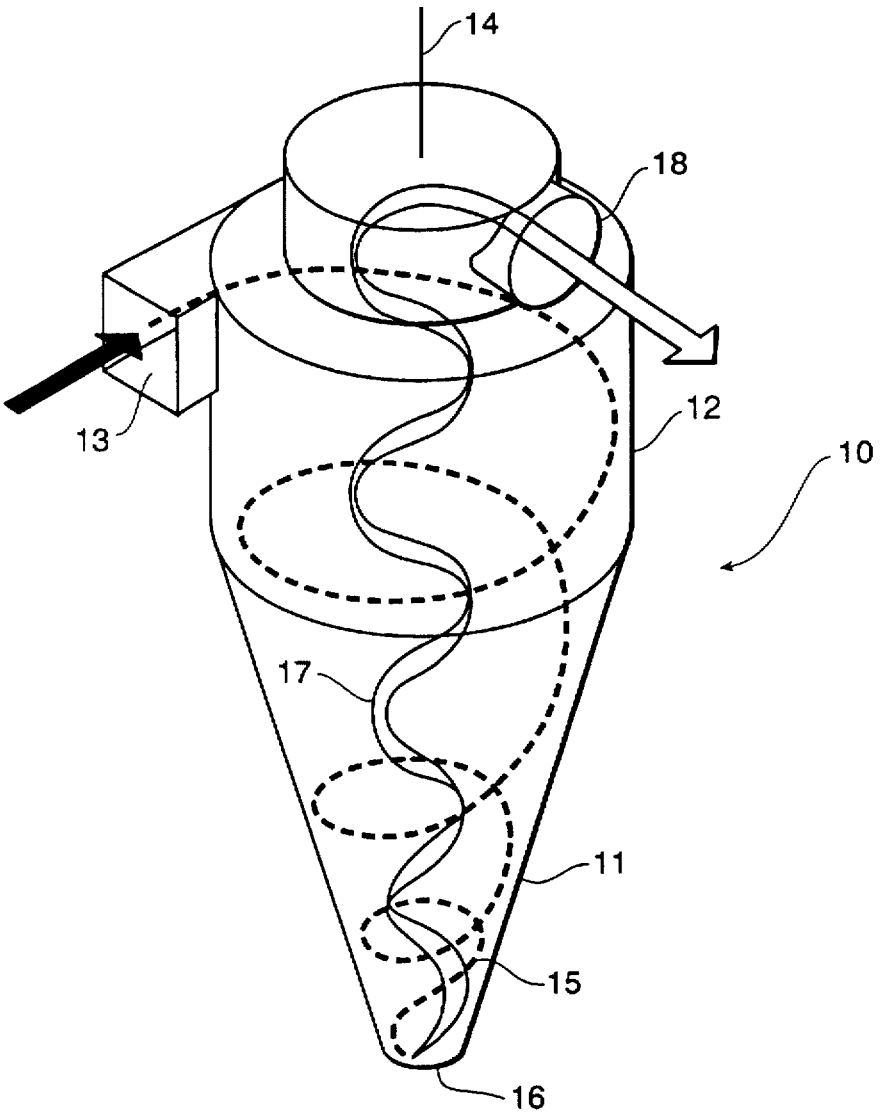
FIG. 1 (Prior Art)
FIG. 1 is a perspective view of a prior art cyclone, illustrating a flow of material through the cyclone.

This is preferably accomplished by injecting an airstream through the airstream inlet orifice 47, as shown in FIG. 3B and FIG. 1. The preferred airstream is injected, using a positive pressure at the inlet generally between 15–30 inches of water. Attached to the upper cylinder 40 is an air inlet duct that preferably provides heated air or other fluid or gases at a high velocity. For simplicity, reference herein will be made to an air stream, although other fluids or gases may be considered to be included. A fan or other device for supplying the heated air stream is well known in the art and is not shown. The preferred dryer is adapted to work with air that enters tangentially through the air inlet 51 at a rate of between 1,000–6,000 standard cubic feet per minute (SCFM), at a pressure of between 15–30 inches of water, at a velocity from 10,000–20,000 feet per minute and at ambient temperature or higher. Preferably, the dryer is operated at 2,500–3,000 SCFM and at a velocity of 18,000 feet per minute. Different pressures, flow rates, and temperatures may be used by one of skill in the art to further maximize the efficiency of the preferred dryer.

The air stream may enter the cyclone dryer 20 while the dryer is set at a variety of angles. The deflectors 44 channel the air stream into the annular air chamber 43. At that point, the airstream generally flows tangentially to the center axis 24 at a high rate of angular velocity. Use of the annular air chamber 43 eases the installation of the dryer 20 by allowing variability in the orientation of inlet ducting, fans, and heaters to provide a heated flow of air. It is thus possible, because of the annular air chamber 43, to position the inlet orifice 47 at any location around the circumference of the outer surface 41. As shown in FIG. 3B, the preferred dryer is adapted to create a clockwise airflow in a clockwise direction. As illustrated in FIG. 2, the air would be flowing up and out of the page on the right side of the annular air chamber 43, and down, into the page on the left side of the annular air chamber 43. Alternatively, the airstream may be introduced in a counterclockwise direction. If so, the flows described below would be reversed.

The air in the cavity continues to swirl in a clockwise direction in the annular air chamber 43. Louvers 45 are preferably attached to the inner surface 42 of the annular air chamber 43. As shown in FIG. 5, a single louver 57 directs the air downward in the annular air chamber 43. The louver 57 is attached on all four surfaces inside the chamber 43, so the air has nowhere else to go, except past the louvers 45 and into the cavity 27. The configuration of the cyclone chamber 21, the orientation of the louvers 45, and centrifugal forces direct the airstream downward and outward, next encountering the lower cylinder 50 and the ramp members 51, thereby creating a turbulent downward and outward air flow.

Figure 3:
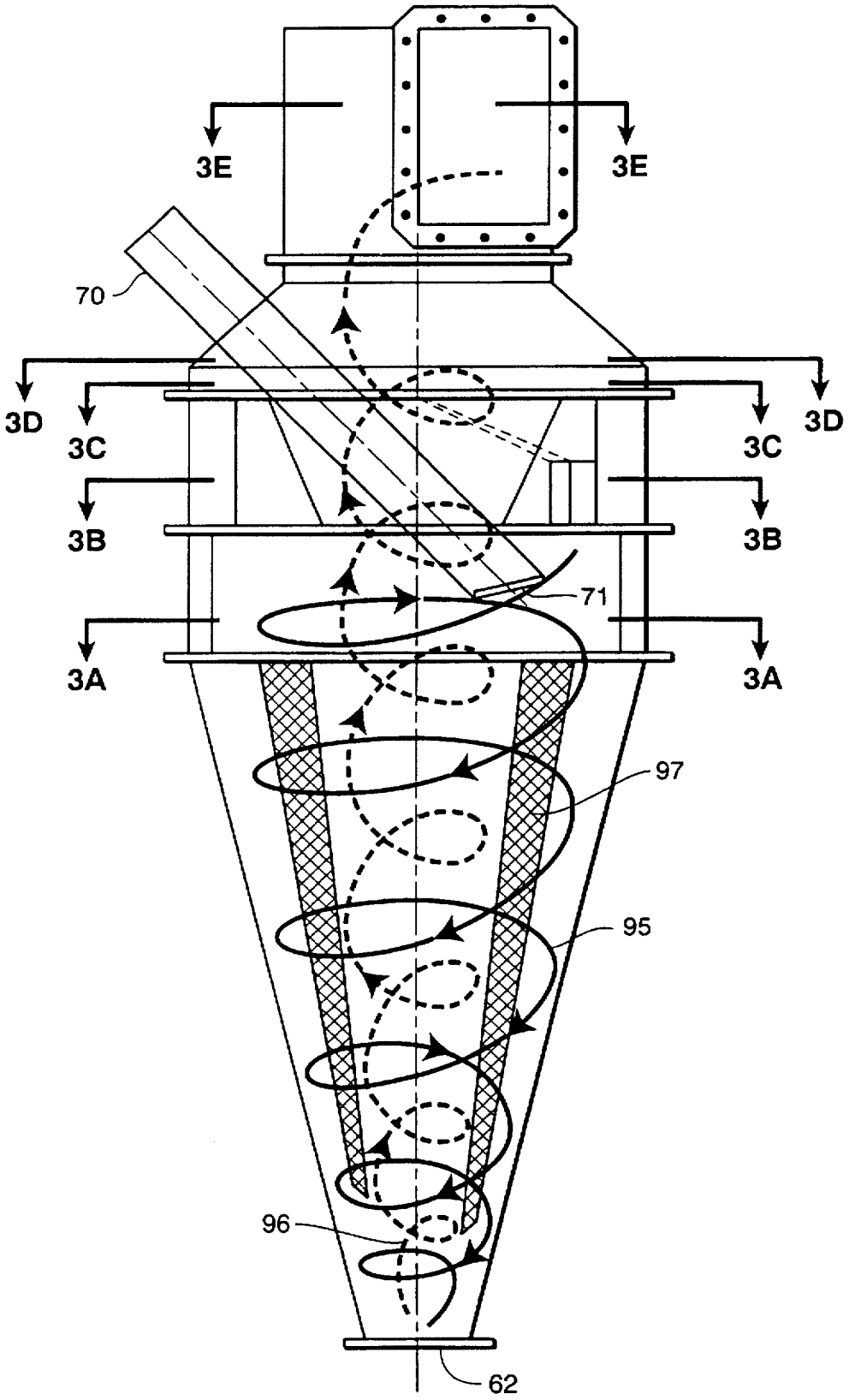
Figure 3A:
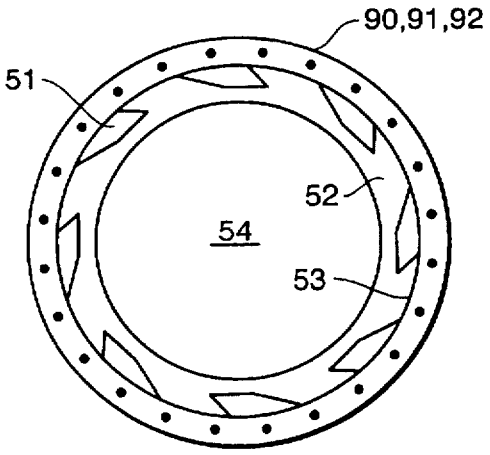
FIGS. 3A–3E are taken and substantially showing the location of two major vortexes and the boundary region created between them.
Figure 3B:
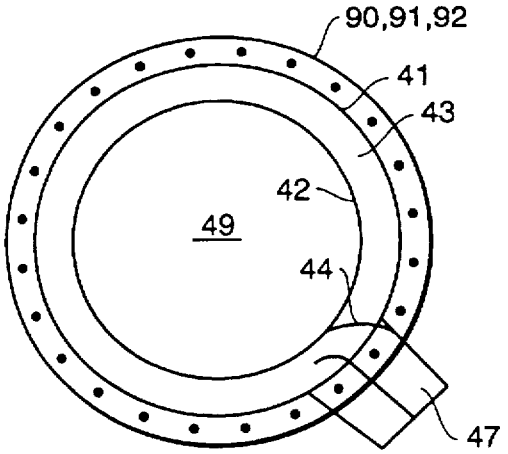
Figure 3C:
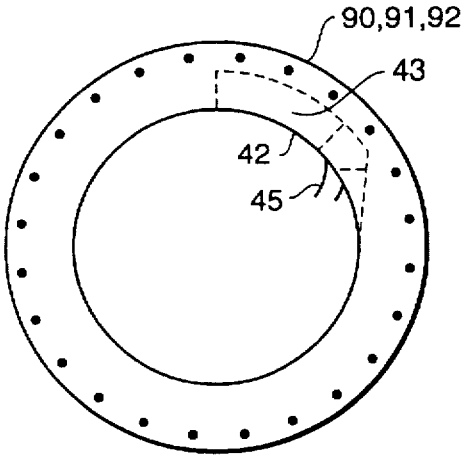
Figure 3D:
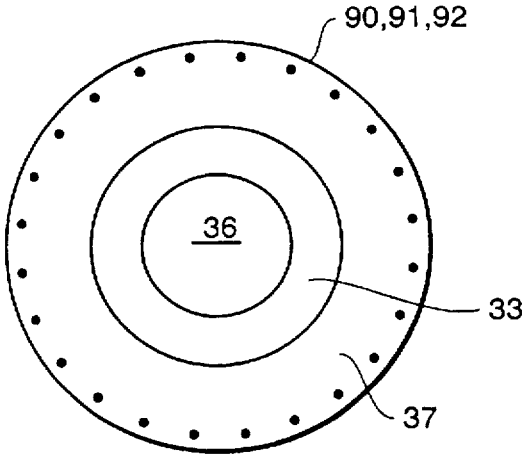
Figure 3E:
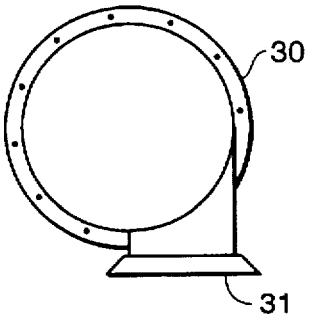

Due to the physical configuration of the cavity 27, the high-velocity air is forced to spiral downward and against the side of the lower, cone-shaped chamber 60, thereby creating a downward vortex 95, as shown by the swirling pattern in FIG. 3. Centrifugal forces make the air stream hug the sides of the cyclone chamber 21, thereby creating an area of low pressure in the center of the cavity 27. As the air approaches the output port 62, the cross-section of the cone-shaped chamber 60 gets smaller and smaller, which causes air to begin to swirl upward in the same rotational (angular) direction as the downward vortex 95. This results in the creation of a second vortex 96 (shown by the dashed lines in FIG. 3) that moves in an upward, circular direction proximate the center of the cavity 27. Air and other material in the upward vortex are eventually carried through the cavity 27, then enter the exhaust assembly 30 and are expelled through the exhaust port 31.

An irregular boundary region 97 is created between the downward vortex 95 and the upward vortex 96. FIG. 3 is a cutaway view of the preferred dryer 20 that shows generally the different areas of the cavity 27 where the vortexes 95 and 96 and the boundary region 97 are located. The downward vortex 95 is situated generally within the outer parts of the cavity 27, the upward vortex 96 is located generally in the inner parts of the cavity 27, and the boundary region is shown as area 97, an irregular-shaped area generally existing between the two vortexes (shown cross-hatched in FIG. 3).

Wet material is preferably fed into the cavity via the input assembly 70 and the input port 71. The wet material may be fed by gravity in a pipe, via a conveyor belt, or other methods generally known in the trade. The location of the entry effects the efficiency of the dryer. For optimum drying, the wet material should be input into the cavity at a point near where the upward vortex 96 is swirling, or the wet material should enter at the boundary region 97. By inputing the wet material into or near the upward vortex 96, a force is being applied to the material in the upward direction. Upon initial entry into the cavity 27, the wet material is subject to the initial tangential flow of air that originates via the annular air chamber 43. This high speed flow immediately has some effect on drying the wet material. The upward forces counter the force of gravity and centrifugal force that are attempting to push the material downward and outward. Heavier and wetter material is thus forced downward to the point where it encounters the downward vortex, which is swirling around the outside of the cavity due to centrifugal force. Additionally, at this point the air flow may be somewhat turbulent due to the disruption in smooth flow caused at least partially by the ramp members 51. Prior to that point, the material may have been at least partially suspended in the boundary region 97, where both the downward vortex 95 and the upward vortex 96 have interacted with the material, resulting in a larger amount of surface contact than would otherwise occur in a prior art dryer. Expanded material surface and material suspension enhances drying when heat is added. The efficiency of the power source supplying the heat is much improved as a result of the actions inside cavity 27. The wet material is suspended between the two vortexes so that it does not immediately get forced (by centrifugal force) against the side of the cavity.

While embodiments of the present invention have been shown and described, various modifications may be made without departing from the scope of the present invention, and all such modifications and equivalents are intended to be covered.

I claim:

1. A cyclone dryer comprising a cylinder having an airstream orifice, an annular air chamber attached proximate said cylinder and in fluid communication with said airstream orifice, and having an inner surface, an outer surface, a top surface and a lower surface, a cone-shaped cyclonic chamber attached proximate said cylinder, said cylinder, annular air chamber and cone-shaped cyclonic chamber defining a cavity having a center axis, a louver attached proximate said inner surface, said louver adapted to direct a flow of air from said annular air chamber into said cavity, an exhaust assembly mounted proximate said cylinder, and an input assembly mounted proximate said exhaust assembly and having an input port, said input port located in a lower section of said cylinder and proximate said cone-shaped chamber.

2. The cyclone dryer of claim 1, further comprising a plurality of ramp members formed on said inner surface of said cylinder.

3. The cyclone dryer of claim 1, wherein said cyclonic air chamber is adapted for an incoming airstream having a flow of up to 6,000 standard cubic feet per minute.

4. The cyclone dryer of claim 1, wherein said cyclonic air chamber is adapted for an incoming airstream having a velocity of up to 18,000 feet per minute.

5. The cyclone dryer of claim 1, wherein said cyclonic air chamber is adapted for an incoming airstream having a flow of between 1,000 and 6,000 standard cubic feet per minute.

6. The cyclone dryer of claim 1, wherein said cyclonic air chamber is adapted for an incoming airstream having a flow of between 2,500 and 3,000 standard cubic feet per minute.

7. The cyclone dryer of claim 1, wherein said cyclonic air chamber is adapted for an incoming airstream having a velocity of between 10,000 and 20,000 feet per minute.

8. The cyclone dryer of claim 1, wherein said cyclonic air chamber is adapted for an incoming airstream having a flow of between 2,500 and 3,000 standard cubic feet per minute, and a velocity of between 10,000 and 20,000 feet per minute.

9. The cyclone dryer of claim 1, wherein said cyclonic air chamber is adapted for an incoming airstream having an incoming pressure of between 15 and 30 inches of water.

10. A cyclone dryer comprising an upper cylinder having an inner surface, an outer surface, a tangential airstream orifice proximate said outer surface, and a plurality of louvers attached proximate said inner surface, a lower cylinder attached proximate said upper cylinder and having a plurality of ramp members, a cone-shaped chamber attached proximate said lower cylinder, said upper cylinder, lower cylinder, and cone-shaped chamber defining a cavity and having a center axis, an exhaust assembly mounted proximate said upper cylinder, and an input assembly mounted proximate said exhaust assembly and having an input port with an input axis, said input port located proximate said lower cylinder, and said input axis terminating halfway between said center axis and said ramp members.

11. The cyclone dryer of claim 10, wherein said upper cylinder is adapted for an incoming airstream having a flow of up to 6,000 standard cubic feet per minute.

12. The cyclone dryer of claim 10, wherein said upper cylinder is adapted for an incoming airstream having a velocity of up to 18,000 feet per minute.

13. The cyclone dryer of claim 10, wherein said upper cylinder is adapted for an incoming airstream having a flow of between 1,000 and 6,000 standard cubic feet per minute.

14. The cyclone dryer of claim 10, wherein said upper cylinder is adapted for an incoming airstream having a flow of between 2,500 and 3,000 standard cubic feet per minute.

15. The cyclone dryer of claim 10, wherein said upper cylinder is adapted for an incoming airstream having a velocity of between 10,000 and 20,000 feet per minute.

16. The cyclone dryer of claim 10, wherein said upper cylinder is adapted for an incoming airstream having a flow of between 2,500 and 3,000 standard cubic feet per minute, and a velocity of between 10,000 and 20,000 feet per minute.

17. The cyclone dryer of claim 10, wherein said upper cylinder is adapted for an incoming airstream having an incoming pressure of between 15 and 30 inches of water.

18. A cyclone dryer comprising an upper cylinder having an inner surface, an outer surface, an airstream orifice proximate said outer surface, and a plurality of louvers attached proximate said inner surface, a lower cylinder attached proximate said upper cylinder and having a plurality of ramp members, a cone-shaped chamber attached proximate said lower cylinder, said upper cylinder, lower cylinder, and cone-shaped chamber defining a cavity having a center axis, an exhaust assembly mounted proximate said upper cylinder, and an input assembly mounted proximate said upper and lower cylinders.

19. The cyclone dryer of claim 18, wherein said input assembly comprises a pipe having a input axis, said input axis entering said cavity halfway between said center axis and said outer surface.

20. The cyclone dryer of claim 18, wherein said upper cylinder is adapted for an incoming airstream having an incoming pressure of between 15 and 30 inches of water.

21. A cyclone dryer comprising a cylinder having an tangential airstream orifice, a cyclonic air chamber attached proximate said cylinder and in fluid communication with said tangential airstream orifice, and having an inner surface, and a deflector attached proximate said inner surface, a cone-shaped cyclonic chamber attached proximate said cylinder, said cylinder and cone-shaped chamber defining a cavity and having a center axis, an exhaust assembly mounted proximate said cylinder, and an input assembly mounted proximate said exhaust assembly and having an input port, said input port located in a lower section of said cylinder and proximate said cone-shaped chamber, said cyclonic air chamber is adapted for an incoming airstream having an incoming pressure of between 15 and 30 inches of water.

22. The cyclone dryer of claim 21, wherein said inner surface of said cylinder has a plurality of ramp members.

23. The cyclone dryer of claim 21, wherein said cyclonic air chamber is adapted for an incoming airstream having a flow of between 2,500 and 3,000 standard cubic feet per minute, and a velocity of between 10,000 and 20,000 feet per minute.

* * * * *